US005295290A

United States Patent [19]

Johnston

[11] Patent Number: 5,295,290

[45] Date of Patent: Mar. 22, 1994

[54] ADAPTER FOR PLASTIC BLIND FASTENER TOOL

[75] Inventor: Harry R. Johnston, Coatesville, Pa.

[73] Assignee: One Twelve, Inc., Coatesville, Pa.

[21] Appl. No.: 913,020

[22] Filed: Jul. 14, 1992

[51] Int. Cl.[5] ..... B21D 9/05; B21J 15/16

[52] U.S. Cl. ..... 29/243.527; 29/243.521; 29/267; 72/391.2

[58] Field of Search ..... 29/243.53, 243.54, 267, 29/268, 278, 243, 527, 243, 521; 72/391.2

[56] References Cited

U.S. PATENT DOCUMENTS 3,584,511 6/1971 Collins ..... 29/267
4,625,538 12/1986 Malagnoux ..... 72/391.2
4,653,309 3/1987 Hendricks et al. ..... 72/391.2
4,658,489 4/1987 Johnston ..... 29/268
5,060,365 10/1991 Lanzo ..... 29/268

FOREIGN PATENT DOCUMENTS 2739166 3/1979 Fed. Rep. of Germany ..... 29/268

*Primary Examiner*—David Jones
*Attorney, Agent, or Firm*—Howson and Howson

[57] ABSTRACT

An apparatus for installing a plastic blind fastener in a remote hard-to-reach location comprising an adapter formed to hold a fastener and manipulatable by a conventional hand-operated fastener tool. The adapter includes a bowden cable operatively connected between an actuator at one end and bushings at the other. Squeezing the tool handles applies opposed forces on the bushings which are transmitted through the cable to a fastener in the actuator causing it to spread outwardly to secure adjacent structure thereto.

29 Claims, 2 Drawing Sheets

ADAPTER FOR PLASTIC BLIND FASTENER TOOL

BACKGROUND OF THE INVENTION

The present invention relates generally to tools for installing plastic blind fasteners, and more particularly to an adapter suitable for use with a hand tool for installing plastic blind fasteners in areas of limited access.

Plastic blind fasteners or rivets abound in many industrial and commercial products. They are especially useful for securing a panel to a frame member or for mounting a component to a panel where only one side of the panel is accessible during assembly. A typical fastener, preferably of permanently deformable plastic, includes a slotted sleeve with a collar at one end and a shaft extending from the other end through the collar to a head. When securing a component to a panel, the sleeve is slidably inserted through aligned holes in the component and panel with the slots extending beyond the relatively inaccessible or "blind" side of the panel. An outward pull on the head, opposed by an equal force on the collar, causes the sleeve portions between the slots to deform radially against the blind side of the panel and tighten the component against the collar. Barbs around the shaft engage the collar to prevent retraction.

Special tools are well-known for installing such blind fasteners. For example, U.S. Pat. No. 4,653,309 discloses a tool, hand-operated like pliers, in which opposed claws are placed between the head on the extended end of the shaft and the collar of the fastener. When the handles are squeezed together the claws spread the head and collar apart. For some hard-to-reach fastening locations the claws are located on the distal end of a long rigid tube and are manipulated by handles removably attached to the other end. Such tools are satisfactory for installing fasteners in products having only a few hard-to-reach locations, but they lack the versatility and practicability needed in products with fasteners required at many different locations of limited access. This is because the length and bend of the tube is fixed. A multiplicity of variously configured interchangeable tubes would be needed to reach different hard-to-reach areas. This increases tool inventory, as well as fastener installation time necessary for interchanging the tools, and may significantly affect manufacturing costs of a product.

SUMMARY OF THE INVENTION

Accordingly, it is an object of the present invention is to provide a novel and improved versatile hand tool for installing plastic blind fasteners in hard-to-reach or limited access locations.

Another object is to provide universal adapter usable with a conventional blind fastener hand tool which is easily adjustable for installing the fasteners in a variety of hard-to-reach locations.

A further object of the invention is to provide an attachment to a conventional blind fastener tool which will conform with an accessible pathway to a remote fastener location.

A still further object is to provide a relatively inexpensive hand tool adapter which is simple to operate and maintain, and which minimizes tool inventory and installation time.

These and other objects of the invention are achieved with a novel adapter manipulatable by a conventional hand-operated blind fastener tool. It includes a bowden cable or equivalent with one end operatively connected to a fastener actuator, and the other end formed to interengage the claws of the blind fastener tool. The actuator includes a spring-biased pull rod slidable within a cylindrical housing by longitudinal motion transmitted through the cable. The distal ends of the housing and rod are recessed to form end walls with radially aligned slots for receiving the shaft of a blind fastener. With a fastener properly inserted in the adapter and in aligned holes of contiguous panels, and the claws of the hand tool properly engaged in the other end of the cable, motion transmitted through the cable when the handles are squeezed together will pull the inserted end of the fastener toward its collar causing the slotted portion to spread radially and secure the panels.

BRIEF DESCRIPTION OF THE DRAWINGS

For a better understanding of these and other objects and aspects of the invention, reference may be made to the following detailed description taken in conjunction with the accompanying drawings wherein.

DESCRIPTION OF THE PREFERRED EMBODIMENT

Figure 1:
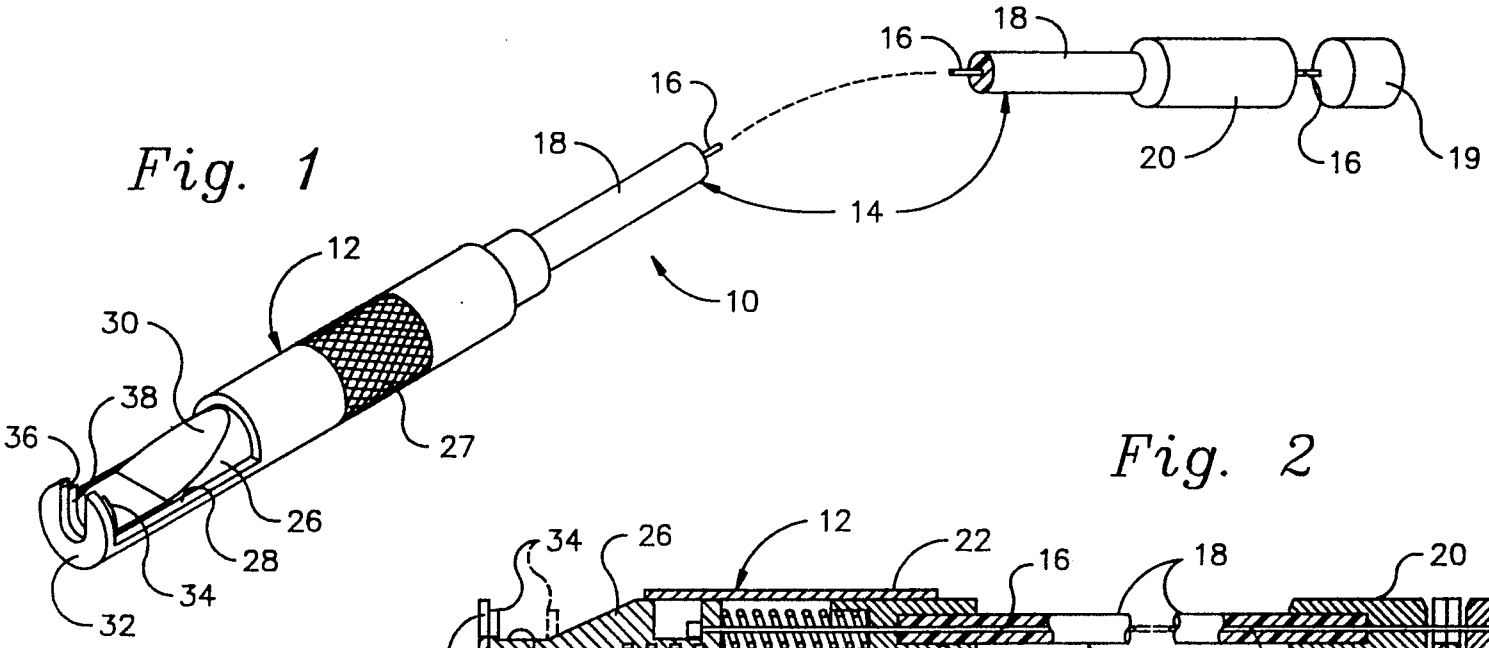
FIG. 1 is a perspective view of an adapter according to the invention for use with a prior art plastic blind fastener tool.
Figure 2:
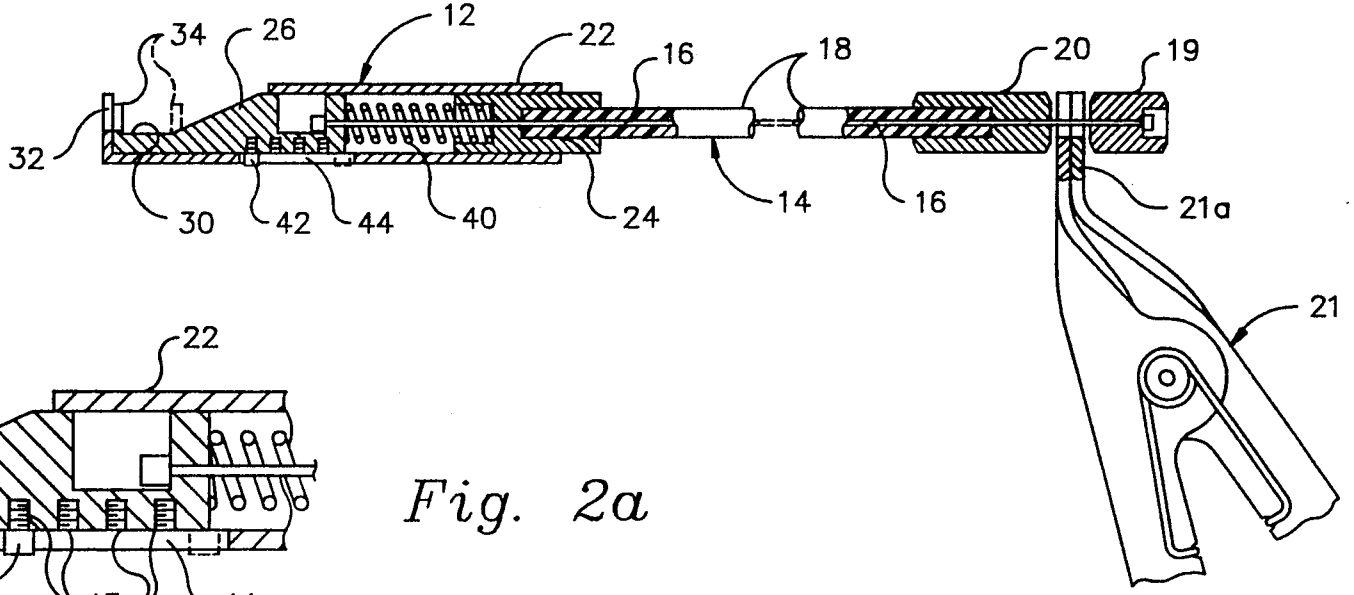
FIG. 2 is a longitudinal view in cross-section of the adapter of FIG. 1 operatively engaged by the jaws of a blind fastener tool.

Referring now to the drawings wherein like referenced characters designate like or corresponding parts throughout the several views, there is shown in FIGS. 1 and 2 an adapter, indicated generally by the numeral 10, comprising a hand-held actuator 12 operatively connected to one end of a bowden cable 14. Cable 14 includes a spring-metal wire 16 slidable within a flexible sheath 18 such as a spiral or braided wire casing or plastic tube. The length of cable 14 may be of any length within practical limits for reaching the most out-of-the-way fastener locations. Bushings 19 and 20, fixed respectively to the other ends of wire 16 and sheath 18, are normally disposed in spaced axial relation for receiving claws 21*a* of a blind fastener hand tool 21 when in a relaxed closed position.

Actuator 12 includes a cylindrical housing 22 closed at one end by an insert 24 coaxially fixed, such as by swaging, about one end of sheath 18, and a pull rod 26 slidable axially within housing 22. A knurled band 27 around the outer surface of housing 22 affords a slip-resistant grip for the hands of an operator. A breach-like opening 28 at the other end of housing 22 and a recessed portion 30 of pull rod 26 terminate axially in horseshoe-like radial end walls 32 and 34 with radial slots 36 and 38, respectively, for removably receiving the shaft of a plastic blind fastener as above-described.

Figure 2A:
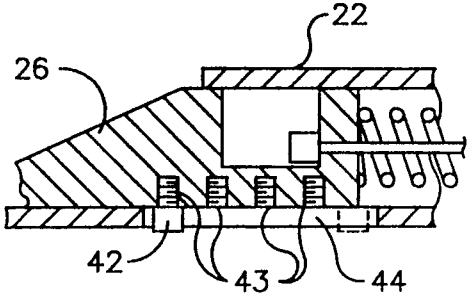
FIG. 2*a* is an enlargement of a portion of the view in FIG. 2.
Figure 3:
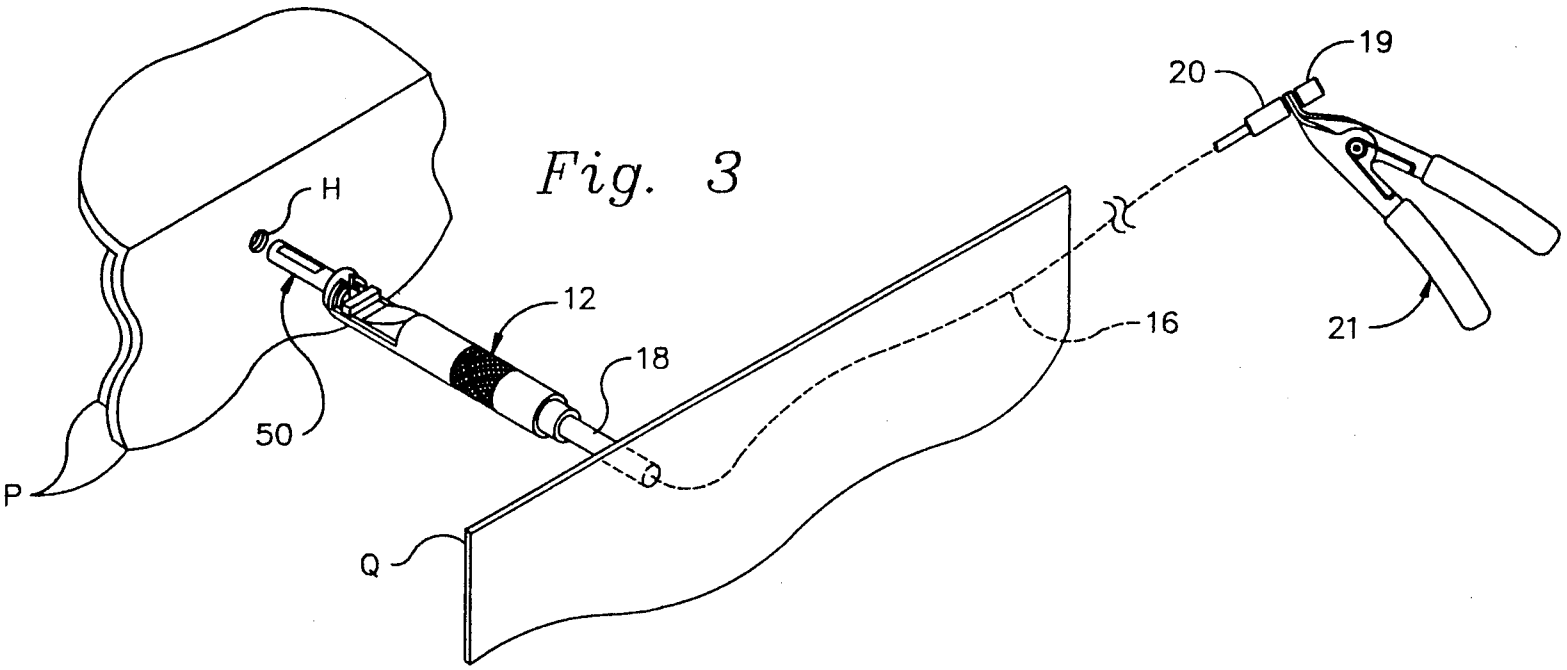
FIG. 3 is a schematic representation in perspective of the adapter of FIG. 1 with a fastener juxtaposed for installing in a relatively inaccessible area remote from a distant prior art hand-operated blind fastener tool.

A coil spring 40 axially disposed in compression between insert 24 and pull rod 26 urges end wall 32 and 34 in butting relation for insertion between the collar and head of a fastener. When bushings 19 and 20 are spread apart by manipulation of hand tool 21, end walls 32 and 34 also spread apart axially against the force of spring 40. An expansion pin 42, threaded into a selected one of a series of holes 43 (FIG. 2*a*) spaced lengthwise in pull rod 26, extends radially through a longitudinal guide slot 44 in cylinder 22 for radially aligning slots 36 and 38 with each other and limiting the travel of pull rod 26 within housing 22. Pin 42 is shown in position for maximum extension of a fastener shaft. Depending on the size of the fastener and length of its shaft, the hole 44 for pin 42 is selected to stop pull rod 26 at the most effective hold position without hyperextending the fastener shaft.

Figure 4C:
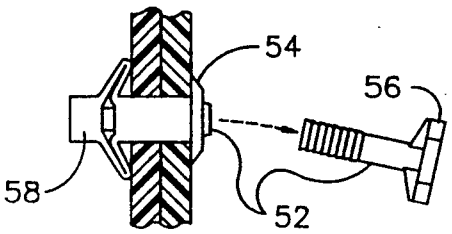
FIGS. 4*a*, 4*b* and 4*c* illustrate the blind fastener in different stages of installation by the adapter of FIG. 1.
Figure 4B:
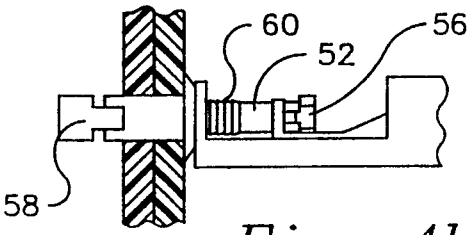
Figure 4A:
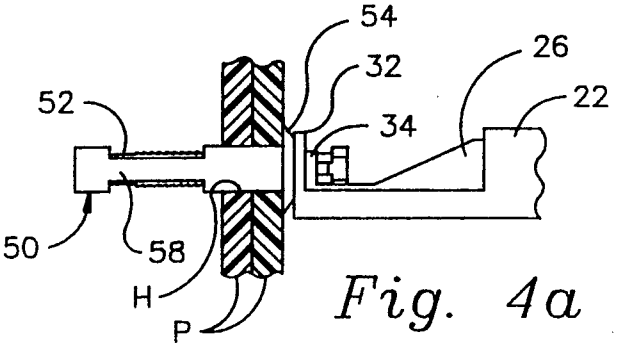

FIGS. 3 and 4*a*–4*c* illustrate stages of installation of a blind fastener 50 in relatively hard-to-reach aligned holes H in two contiguous panels P juxtapositioned behind a panel Q. An approximately 90° bend in bowden cable 12 enables actuator 12 to reach holes H from hand tool 21. Greater bends may be possible but with limitations to avoid damaging the cable. As best see in FIG. 4*a*, the extended end of a fastener shaft 52 is inserted in aligned slots 36 and 38 (FIG. 3) of actuator 12 with a collar 54 and a head 56 at adjacent opposite sides of respective end walls 32 and 24, and with a slotted fastener sleeve 58 fully inserted in holes H. When a spreading force is applied between bushings 19 and 20 by hand tool 21, the slotted portion of sleeve 58 deforms radially until it grips the blind side of panels P, as shown in FIGS. 4*b* and 4*c*. Collar 54 and barbs 60 on shaft 52 interlock to prevent shaft 52 from retracting. As illustrated in FIG. 4C, the exposed end of shaft 52 may be cut off at collar 54 if desired.

Some of the many advantages and novel features of the invention should now be readily apparent. For example, an adapter is provided which can be quickly attached to the claws of a conventional plastic blind fastener tool in order to reach with ease fastener hole areas of limited access. The simplicity of the design makes it easy to operate and maintain. A single adapter can be applied to many variations in fastener hole locations thereby eliminating the need for a large tool inventory and reducing the time for interchanging tools.

It will be understood, of course, that various other changes in the details, step and arrangement of parts, which have been herein described and illustrated, may be made by those skilled in the art within the principle and scope of the invention as expressed in the appended claims.

I claim:

1. An adapter for a tool for installing a plastic blind fastener in a hard-to-reach location, the fastener having a shaft with a head at one end thereof, a sleeve surrounding a portion of the shaft with a collar at one end thereof, the other ends of the shaft and sleeve being fixed to each other, and the tool having spreadable claws for applying opposed forces to the fastener between the head and the collar for deforming the sleeve radially outward; said adapter comprising:

a cylindrical housing having a radial slot in one end for receiving a portion of the shaft of the fastener between the head and collar thereof;

a pull rod slidable axially in said housing and having a radial slot in one end aligned with said slot of said housing for receiving another portion of the shaft of the fastener between the head and collar thereof;

a cable having a flexible sheath and spring wire slidable therein, said sheath and said wire fixed respectively at adjacent one ends thereof to said housing and said pull rod; and first and second bushings fixed respectively to adjacent other ends opposite from said one ends of said wire and said sheath for engaging the claws of the tool in their closed position.

2. An adapter according to claim 1 further comprising:

a spring disposed within said housing for urging said one ends of said housing and said pull rod in abutment.

3. An adapter according to claim 1 further comprising:

guide means interengaging said housing and said pull rod for maintaining said slots in mutual alignment.

4. An adapter according to claim 3 wherein:

said guide means includes a longitudinal recess formed in said housing, and a pin radially extending from said pull rod and slidably inserted in said recess.

5. Apparatus according to claim 4 wherein:

said guide mean includes a series of holes in said pull rod registering with said slots for selectively receiving said pin for limiting the lengthwise travel of said pull rod.

6. An adapter according to claim 1 wherein:

said cable is of a length sufficient for readily manipulating the tool a remote distance from the fastener location.

7. An adapter for a tool for installing a plastic blind fastener, the tool being of the type having spreadable claws formed to apply opposed forces to the fastener; said adapter comprising:

an elongate housing having an end wall formed to receive the fastener;

a pull rod slidable in said housing having an end wall formed to receive the fastener; and cable means including a flexible sheath and a spring wire slidable therein, said sheath and said wire fixed respectively at adjacent one ends thereof to said housing and said pull rod, and formed respectively at adjacent other ends to engage the claws of the tool for transmitting relative motion to said housing and said pull rod.

8. An adapter according to claim 7 further comprising:

a spring disposed within said housing for urging said end walls in abutment.

9. An adapter according to claim 7 further comprising:

slots formed in each of said end walls for receiving respective portions of said fastener.

10. An adapter according to claim 9 further comprising:

guide means interengaging said housing and said pull rod for maintaining said slots in mutual alignment.

11. An adapter according to claim 10 wherein:

said guide means includes a longitudinal recess formed in said housing, and a pin extending from said pull rod and slidably inserted in said recess.

12. Apparatus according to claim 11 wherein:

said guide means includes a series of holes in said pull rod registering with said slots for selectively receiving said pin for limiting the lengthwise travel of said pull rod.

13. An adapter according to claim 7 wherein:

said cable means further includes first and second bushings fixed respectively to said other ends of said sheath and said wire.

14. Apparatus for installing a plastic blind fastener of the type having a shaft with a head at one end thereof, a sleeve generally surrounding the shaft and a collar at one end thereof, the other ends of the shaft and sleeve being fixed to each other for receiving opposite forces applied to the fastener between the head and the collar for deforming the sleeve radially outward, said apparatus comprising, in combination:

an elongate housing having an end wall formed to receive a portion of the shaft of the fastener between the head and collar thereof;

a pull rod slidable in said housing having an end wall formed to receive the fastener between the head and collar thereof;

elongate cable means having two flexible members with adjacent one ends respectively connected to said housing and said pull rod; and tool means having spreadable claws formed to engage respective adjacent other ends opposite from said one ends for imparting relative motion through said cable means to said housing and said pull rod, said claws being rotatable about said cable means.

15. Apparatus according to claim 14 further comprising:

a spring disposed within said housing for urging said end walls in abutment.

16. Apparatus according to claim 14 further comprising:

slots formed in each of said end walls for receiving respective portions of the shaft of said fastener between the head and the collar thereof.

17. Apparatus according to claim 16 further comprising:

guide means interengaging said housing and said pull rod for maintaining said slots in mutual alignment.

18. Apparatus according to claim 17 wherein:

said guide means includes a longitudinal recess formed in said housing, and a pin radially extending from said pull rod and slidably inserted in said recess.

19. Apparatus according to claim 18 wherein:

said guide means includes a series of holes in said pull rod registering with said slots for selectively receiving said pin for limiting the lengthwise travel of said pull rod.

20. Apparatus according to claim 14 wherein:

said members respectively include a flexible sheath and a spring wire slidable therein, said sheath and said spring each fixed respectively at said one ends to said housing and said pull rod.

21. Apparatus according to claim 20 wherein:

said cable means further include first and second bushings fixed respectively to said other ends of said sheath and said wire.

22. Apparatus according to claim 21 wherein:

said claws are formed to engage opposed surfaces of said bushings when in their closed position.

23. Apparatus for installing a plastic blind fastener of the type having a shaft with a head at one end thereof, a sleeve generally surrounding the shaft and a collar at one end thereof, the other ends of the shaft and sleeve being fixed to each other for receiving opposite forces applied to the fastener between the head and the collar for deforming the sleeve radially outward, said apparatus comprising, in combination:

an elongate housing having an end wall formed to receive a portion of the shaft of the fastener between the head and collar thereof;

a pull rod slidable lengthwise in said housing having an end wall formed to receive the fastener between the head and collar thereof;

a flexible sleeve connected at one end thereof to said housing;

a flexible shaft slidable within said sleeve connected at one end to said pull rod; and a tool means formed to apply a force to other ends of said sleeve and said shaft for inducing relative longitudinal motion of said shaft in said sleeve.

24. Apparatus according to claim 23 further comprising:

a spring disposed within said housing or urging said end walls in abutment.

25. Apparatus according to claim 23 further comprising:

slots formed in each of said end walls for receiving respective portions of the shaft of said fastener between the head and the collar thereof.

26. Apparatus according to claim 25 further comprising:

guide means interengaging said housing and said pull rod for maintaining said slots in mutual alignment.

27. Apparatus according to claim 26 wherein:

said guide means includes a longitudinal recess formed in said housing, and a pin radially extending from said pull rod and slidably inserted in said recess.

28. Apparatus according to claim 27 wherein:

said guide means includes a series of holes in said pull rod registering with said slots for selectively receiving said pin for limiting the lengthwise travel of said pull rod.

29. Apparatus according to claim 23 further comprising: bushings fixed respectively to said other ends of said sleeve and said shaft for receiving said tool therebetween.

* * * * *